US006713951B2

(12) United States Patent
Okamoto et al.

(10) Patent No.: US 6,713,951 B2
(45) Date of Patent: Mar. 30, 2004

(54) COLOR CATHODE RAY TUBE

(75) Inventors: Hisakazu Okamoto, Kumagaya (JP); Tetsuya Masumura, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 65 days.

(21) Appl. No.: 10/082,342

(22) Filed: Feb. 26, 2002

(65) Prior Publication Data

US 2002/0158562 A1 Oct. 31, 2002

(30) Foreign Application Priority Data

Feb. 27, 2001 (JP) ..... 2001-052062

(51) Int. Cl.[7] ..... H01J 29/07
(52) U.S. Cl. ..... 313/402; 313/408
(58) Field of Search ..... 313/402–408, 313/473; 445/47

(56) References Cited

U.S. PATENT DOCUMENTS 6,501,214 B1 * 12/2002 Sakamoto et al. ..... 313/407

FOREIGN PATENT DOCUMENTS

| | | | | |
|---|---|---|---|---|
| JP | 8-298078 | | 11/1996 | |
| JP | 09035657 A | * | 2/1997 | ..... H01J/29/07 |
| JP | 2002216655 A | * | 8/2002 | ..... H01J/29/07 |

* cited by examiner

*Primary Examiner*—Ashok Patel
*Assistant Examiner*—Glenn D. Zimmerman
(74) *Attorney, Agent, or Firm*—Pillsbury Winthrop LLP

(57) ABSTRACT

A shadow mask is formed by press molding and includes a substantially rectangular mask effective portion in the form of a gently sloped dome having electron beam passage apertures and a skirt portion extending from the peripheral edge of the mask effective portion. The skirt portion has a plurality of apertures arranged parallel to the peripheral edge of the mask effective portion and spaced from one another and belt portions formed between the apertures and an extending end edge of the skirt portion and extending along the extending end edge. Each of the apertures is formed so that its width increases from the peripheral edge of the mask effective portion toward the extending end edge side of the skirt portion.

12 Claims, 6 Drawing Sheets

COLOR CATHODE RAY TUBE

CROSS-REFERENCE TO RELATED APPLICATIONS

This application is based upon and claims the benefit of priority from the prior Japanese Patent Application No. 2001-052062, filed Feb. 27, 2001, the entire contents of which are incorporated herein by reference.

BACKGROUND OF THE INVENTION

1. Field of the Invention

The present invention relates to a color cathode ray tube having a press-molded shadow mask.

2. Description of the Related Art

In general, an in-line color cathode ray tube comprises a vacuum envelope, which includes a glass panel having a substantially rectangular effective portion, a glass funnel connected to the panel, and a cylindrical glass neck connected to a small-diameter portion of the funnel. Formed on the inner surface of the effective portion of the panel is a phosphor screen that includes three-color dotted or striped phosphor layers, which glow blue, green, and red, individually, and black light-shielding layers. In the vacuum envelope, a shadow mask having a large number of electron beam passage apertures is opposed to the phosphor screen. Further, an in-line electron gun that emits three electron beams is located in the neck, and a deflection yoke is mounted on the outer peripheral surface of the funnel.

In the color cathode ray tube constructed in this manner, the three electron beams emitted from the electron gun are deflected horizontally and vertically by means of horizontal and vertical deflecting magnetic fields that are generated by the deflection yoke. The phosphor screen is horizontally scanned at high frequency with the electron beams that are passed through the shadow mask, whereupon a color image is displayed. As this is done, the electron beams emitted from the electron gun land on the phosphor screen at given angles of incidence, and undergo color selection on the shadow mask according to the angles of incidence. Thus, the three electron beams correspond individually to the three colors, red, blue, and green, of the phosphor screen.

In this color cathode ray tube, the shadow mask includes a substantially rectangular effective portion in the form of a gently sloped dome, and a skirt portion extending substantially perpendicularly from the peripheral edge of the effective portion toward the electron gun. The effective portion has a curvature radius of about 500 to 2,000 mm and a large number of electron beam passage apertures with a diameter of about 100 $\mu$m. The shadow mask is fixed to a mask frame by means of the skirt portion. The mask frame is detachably supported on stud pins on the panel by means of elastic support members.

Thus, the shadow mask carries out the aforesaid color selection and serves as a negative of a phosphor screen in the process of manufacturing the phosphor screen. Usually, the shadow mask is formed into a desired shape by press-molding a thin sheet of Invar (iron-nickel alloy) with a thickness of 0.1 to 0.2 mm.

Since the Invar material is springy, however, it is hard to obtain a desired mask surface shape from it. In forming the shadow mask by press molding, a flat mask blank is first placed on a knockout and a die of a pressing machine. Then, the mask blank is fixed by holding a fixing portion in the peripheral part of the blank by means of a blank holder and the die. After the mask blank is bulged into a specific curved surface by means of a punch, the blank holder and the die are separated from each other to release the peripheral part of the blank.

Then, the knockout and the punch are moved downward, and the peripheral part of the mask blank is drawn into a space between the punch and the die to be bent substantially at right angles, whereupon the skirt portion is formed. Thereafter, the punch is pulled up, all the tools are restored to their respective original positions, and the molded shadow mask is taken out.

In the case of the shadow mask that is obtained by press molding, however, the effective portion is molded in the form of a gently sloped dome, so that the boundary between the effective portion and the skirt portion and an extending end edge of the skirt portion are arcuate, and their respective lengths are shorter than before press molding operation. Thus, a greater odd of the blank is produced in a part of the skirt portion that is situated closer to the extending end, so that wrinkles are formed in the skirt portion.

Although these wrinkles can be reduced to some degree by notching the extending end edge of the skirt portion, deep notches are needed to remove the wrinkles thoroughly. If the notches are deep, however, they divide the skirt portion so sharply that the shape retention of the shadow mask lowers extremely. Therefore, the shadow mask is inevitably deformed with ease while it is being transported or attached to the mask frame.

If the notches are shallow, a lot of wrinkles are inevitably formed in the skirt portion, and compressive stress that is attributable to the odd of the blank remains in the unnotched region. Force that urges the skirt portion to spread acts on the skirt corner portions where no drag acts against the compressive stress. Since this force pushes back the arcuate skirt portion straight, it acts on the effective portion as an urging force to displace each corner portion of the boundary between the effective portion and the skirt portion upward (or toward the phosphor screen), and the central portion of each side downward (or toward the electron gun).

The stiffness of the central portion of each side of the mask effective portion against the aforesaid downward force is so low that downward displacement is caused in the central portion. In the case of a 17-inch in-line color cathode ray tube, for example, depressions of 0.2 mm to 0.3 mm are formed inevitably. Accordingly, the curved surface of the shadow mask varies from a designed one, so that the electron beams are subject to landing errors, and the color purity lowers. Further, the depressions in the effective portion produce inflection points in the mask effective portion, so that the tensile strength of the mask effective portion lowers. Thus, the shadow mask is inevitably deformed with ease while it is being transported or attached to the mask frame.

BRIEF SUMMARY OF THE INVENTION

The present invention has been contrived in consideration of these circumstances, and its object is to provide a color cathode ray tube with improved display characteristics, in which an odd of a skirt portion that is produced as a shadow mask is molded can be absorbed to reduce errors in the curved surface shape of the shadow mask.

In order to achieve the above object, a color cathode ray tube according to an aspect of the invention comprises: a panel having a phosphor screen on the inner surface thereof, the phosphor screen having a plurality of phosphor layers; an electron gun located opposite the phosphor screen and configured to emit electron beams toward the phosphor screen; and a shadow mask located opposite the phosphor screen and having a large number of electron beam passage apertures through which the electron beams are applied to the phosphor layers corresponding thereto, the shadow mask being formed by press molding and including a substantially rectangular mask effective portion in the form of a gently sloped dome having the electron beam passage apertures, and a skirt portion extending from the peripheral edge of the mask effective portion substantially at right angles thereto, the skirt portion having a plurality of apertures arranged to be spaced from one another in a direction parallel to the peripheral edge of the mask effective portion and belt portions defined between the apertures and an extending end edge of the skirt portion and extending along the extending end edge, the belt portions having wrinkles formed along the extending end edge by the press molding.

A color cathode ray tube according to another aspect of the invention comprises: a panel having a phosphor screen on the inner surface thereof, the phosphor screen having a plurality of phosphor layers; an electron gun located opposite the phosphor screen and configured to emit electron beams toward the phosphor screen; and a shadow mask located opposite the phosphor screen and having a large number of electron beam passage apertures through which the electron beams are applied to the phosphor layers corresponding thereto, the shadow mask being formed by press molding and including a substantially rectangular mask effective portion in the form of a gently sloped dome having the electron beam passage apertures, and a skirt portion extending from the peripheral edge of the mask effective portion substantially at right angles thereto, the skirt portion having a plurality of slit groups arranged to be spaced from one another in a direction parallel to the peripheral edge of the mask effective portion and belt portions defined between the slit groups and an extending end edge of the skirt portion and extending along the extending end edge, each of the slit groups including a plurality of slits extending substantially at right angles to the extending end edge of the skirt portion and arranged at spaces in a direction substantially parallel to the extending end edge, the slits including a central slit, the longest one, and side slits arranged on the opposite sides of the central slit and having lengths reduced stepwise.

According to the color cathode ray tube constructed in this manner, the apertures or slit groups can absorb an odd of the skirt portion that is produced as the shadow mask is molded, thereby preventing the skirt portion from being spread by the odd. Thus, the resulting color cathode ray tube enjoys higher accuracy for the curved surface of the mask effective portion and improved display characteristics. At the same time, the belt portions can maintain the strength of the short side portion and improve the resistance to impact.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate of the invention, and together with the general description given above and the detailed description of the embodiments given below, serve to explain the principles of the invention.

DETAILED DESCRIPTION OF THE INVENTION

Figure 1:
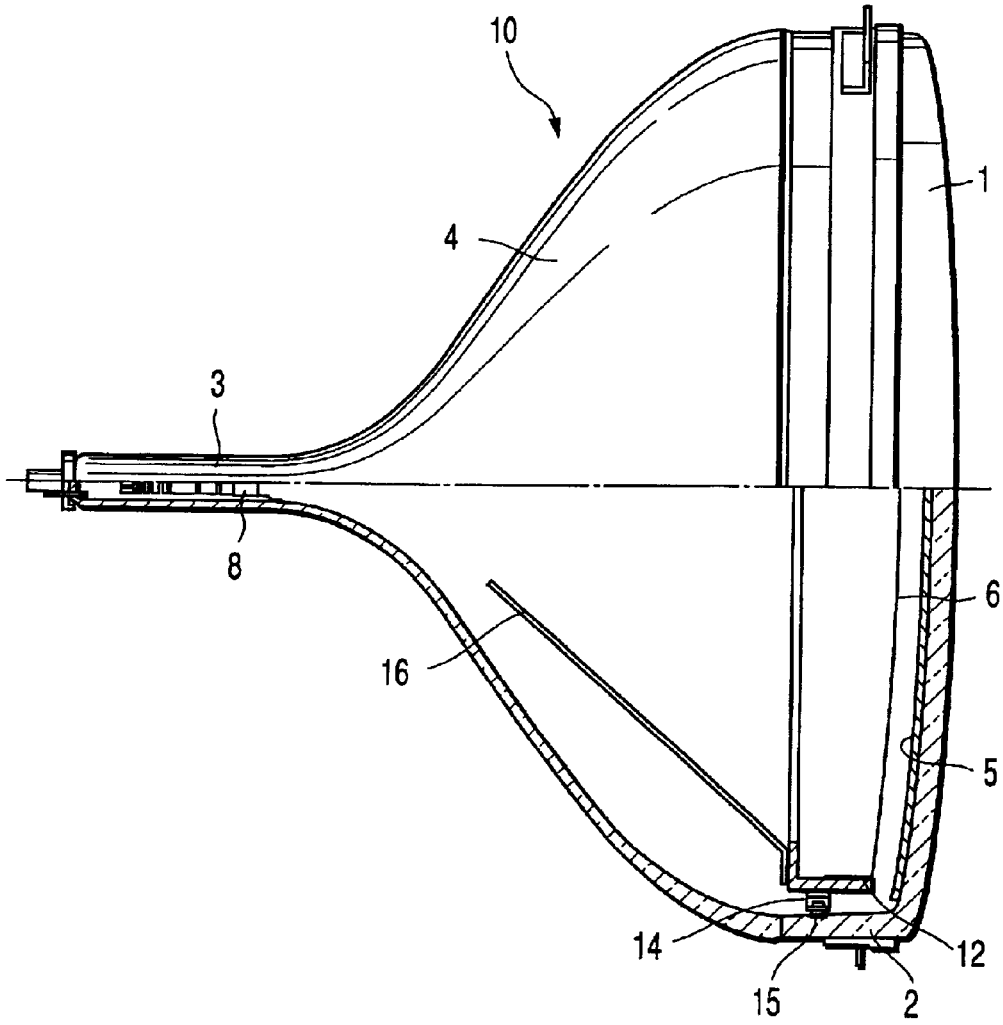
FIG. 1 is a plan view, partially in section, showing a color cathode ray tube according to an embodiment of the invention.

An in-line color cathode ray tube according to an embodiment of the invention will now be described with reference to the accompanying drawings.

The color cathode ray tube comprises a vacuum envelope 10 of glass, which includes a panel 1 having a substantially rectangular effective portion and a skirt portion 2 on the peripheral edge of the effective portion, a funnel 4 connected to the skirt portion of the panel, and a cylindrical neck 3 connected to a small-diameter portion of the funnel.

Formed on the inner surface of the panel 1 is a phosphor screen 5 that includes a plurality of dotted or striped phosphor layers, which glow red, green, and blue, individually, and black light-shielding layers. A deflection yoke (not shown) that has horizontal and vertical deflecting coils is mounted on the neck 3 and the funnel 4. Further, an electron gun 8 that emits three electron beams toward the phosphor layers of the phosphor screen 5 is located in the neck 3. The three electron beams include a center beam and a pair of side beams that are arranged in a line and pass along the same horizontal plane.

In the vacuum envelope 10, a shadow mask 6 is opposed to the phosphor screen 5 and attached to a rectangular mask frame 12. As mentioned later, the shadow mask 6 includes a mask effective portion and a skirt portion, and is formed by press molding. The mask effective portion is formed having a large number of electron beam passage apertures for color discrimination. The skirt portion extends from the peripheral edge of the mask effective portion, and is fixed to the mask frame 12. The shadow mask 6 is detachably supported on the panel 1 in a manner such that elastic support members 14 fixed to the mask frame 12 individually engage stud pins 15 that protrude from the inner surface of the skirt portion 2 of the panel.

Since the respective trajectories of the electron beams change under the influence of magnetic fields, the mask frame 12 is fitted with an inner shield 16 for intercepting external magnetic fields. The inner shield 16 extends toward the electron gun 8.

In the color cathode ray tube constructed in this manner, the three electron beams emitted from the electron gun 8 are deflected by means of the deflection yoke on the outside of the funnel 4. The phosphor screen 5 is scanned horizontally and vertically with the electron beams that are passed through the electron beam passage apertures of the shadow mask 6, whereupon a color image is displayed. As this is done, the electron beams emitted from the electron gun 8 land on the phosphor screen 5 at given angles of incidence, and undergo color selection on the shadow mask 6 according to the angles of incidence. Thus, the three electron beams correspond individually to the three colors, red, blue, and green, of the phosphor screen 5.

Figure 2A:
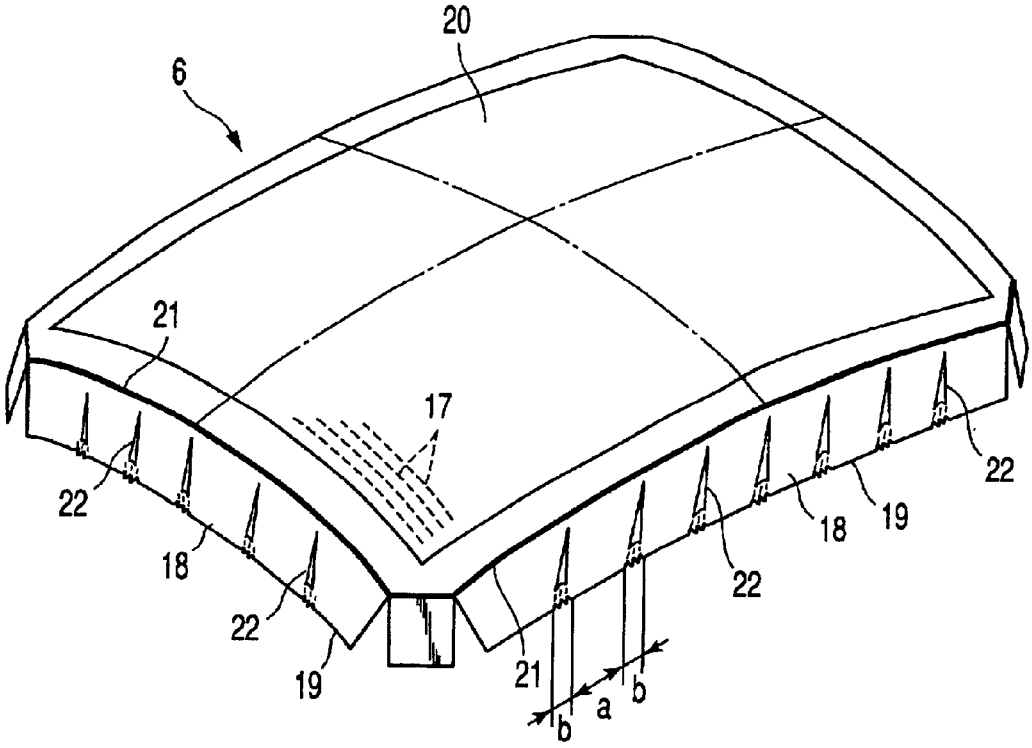
FIG. 2A is a perspective view showing a shadow mask of the color cathode ray tube.
Figure 2B:
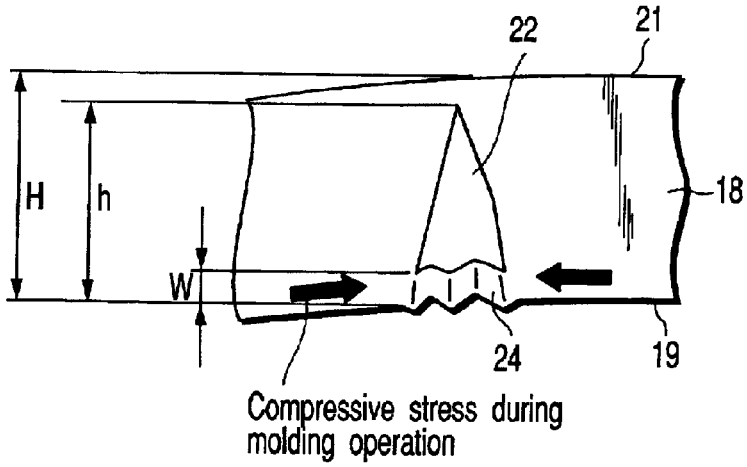
FIG. 2B is an enlarged side view showing a part of the shadow mask.

As shown in FIGS. 2A and 2B, the shadow mask 6 is formed by press molding, and integrally comprises a substantially rectangular mask effective portion 20 and a skirt portion 18. The effective portion 20 is in the form of a gently sloped dome. The skirt portion 18 extends substantially at right angles to the mask effective portion from its peripheral edge 21, covering the whole circumference of the mask effective portion. The skirt portion 18 has a pair of long side portions and a pair of short side portions, corresponding to the long and short sides of the mask effective portion 20, respectively.

The mask effective portion 20 is formed having a large number of electron beam passage apertures 17 that are arranged at given pitches. The boundaries between the mask effective portion 20 and the skirt portion 18, that is, the individual sides of the peripheral edge 21 of the mask effective portion, are each in the form of a circular arc convexed on the phosphor screen side. Likewise, an extending end edge 19 of each side portion of the skirt portion 18 is in the form of a circular arc.

Further, a plurality of apertures 22 (described in detail later) are formed in each side portion of the skirt portion 18. In the case of the shadow mask 6 that is used in a 17-inch in-line color cathode ray tube, for example, seven apertures 22 are formed in each long side portion of the skirt portion 18, and five in each short side portion.

If the width of each aperture 22 in the longitudinal direction of each side portion and the distance between each two adjacent apertures are b and a, respectively, there is a relation a>b.

Figure 3:
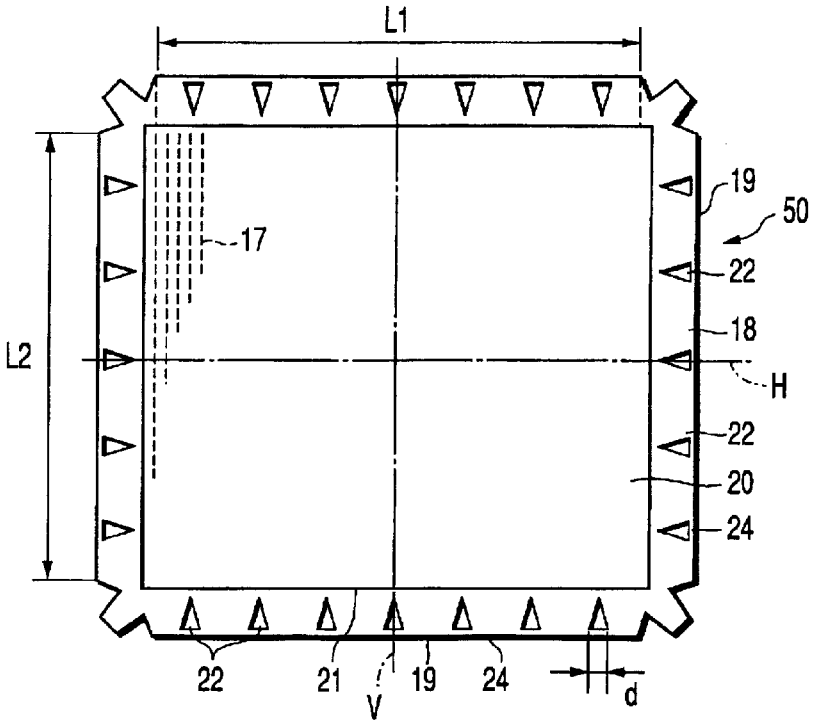
FIG. 3 is a plan view showing a mask blank from which the shadow mask is molded.

As shown in FIG. 3, a flat mask blank 50 to be press-molded into the shadow mask has the rectangular mask effective portion 20 and the skirt portion 18 around it. The electron beam passage apertures 17 are previously formed in the mask effective portion 20. A length L1 of each long side portion of the skirt portion 18 is 290 mm, and a length L2 of each short side portion is 220 mm. A height H (see FIG. 2B) of the skirt portion 18, that is, the distance between the peripheral edge 21 of the mask effective portion 20 and each extending end edge 19 of the skirt portion 18, is adjusted to 13 mm.

Each aperture 22 in each side portion of the skirt portion 18 is substantially in the shape of an isosceles triangle. The vertex of the triangle is situated near the peripheral edge 21, and its base is situated adjacent to its corresponding extending end edge 19 of the skirt portion 18 and extends substantially parallel to the extending end edge. As mentioned before, seven apertures 22 are formed in each long side portion of the skirt portion 18, and five in each short side portion. In each side portion, the apertures 22 are spaced in the longitudinal direction and are arranged symmetrically with respect to horizontal and vertical axes H and V of the shadow mask 6.

A height h (see FIG. 2B) of each aperture 22 above each extending end edge 19 of the skirt portion 18 is adjusted to 10 mm. Preferably, the height h of each aperture 22 is adjusted to 50% or more of the height H of the skirt portion 18. A length d of the base of each aperture 22 is adjusted to 3 mm, and a distance (width) W (see FIG. 2B) between the base and each extending end edge 19 of the skirt portion 18 is adjusted to 3 mm. Thus, a narrow belt portion 24 with a width of 3 mm is defined under each aperture 22. The belt portions 24 allow the skirt portion 18 to be continuous throughout its circumference without being divided by the apertures 22. Preferably, the width W of each belt portion 24 ranges form 1 to 3 mm.

Figure 4:
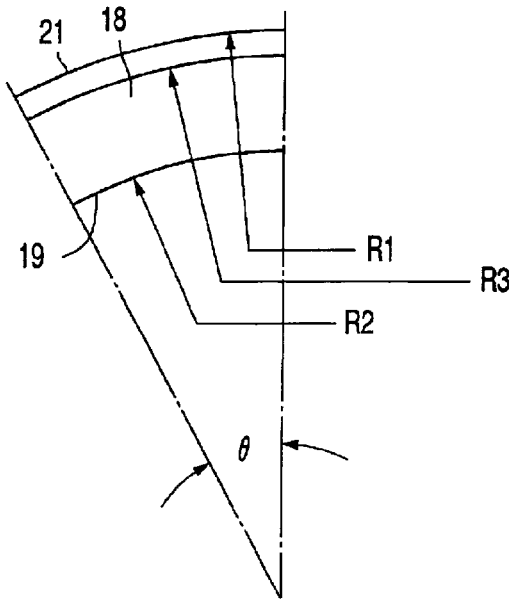
FIG. 4 is a diagram schematically showing the curvature radius of the shadow mask.

In the case where the shadow mask 6 is formed by press-molding the mask blank 50 constructed in this manner, the mask effective portion 20 is in the form of a gently sloped dome, and the skirt portion 18 extends substantially at right angles to the mask effective portion 20 from its peripheral edge 21. As is schematically shown in FIG. 4, each side of the peripheral edge 21 of mask effective portion 20 and the extending end edge 19 of each side portion of skirt portion 18 are substantially in the form of concentric circular arcs.

In each long side portion of the skirt portion 18, for example, the length of the circular arc of the upper edge or the peripheral edge 21 is 290 mm, which is not different from the value for the blank that is not press-molded yet. If the circular arc of the peripheral edge 21 is 290 mm long, a central angle θ is 17.5°. Thus, the curvature radius of the peripheral edge 21 or a curvature radius R1 of the upper edge of each side portion of the skirt portion 18 is 950 m.

Since the height H of the skirt portion 18 is 13 mm, moreover, a curvature radius R2 of each extending end edge 19 is 937 mm (=950 mm−13 mm). The length of the circular arc of each extending end edge 19 is 286 mm (=2×π×937 mm×17.5/360).

In each side portion of the skirt portion 18, therefore, the material of the mask blank in the region near the extending end edge 19 is longer by a margin of 4 mm (=290 mm−286 mm) that is equivalent to the difference in length between the peripheral edge 21 and the extending end edge 19. Thereupon, the length of the base of each aperture 22 is adjusted to 3 mm, and the apertures 22 are located in six positions in each long side portion. The six apertures 22 and the belt portions 24 thereunder absorb the 4-mm odd.

As each side portion of the skirt portion 18 is molded into an arcuate shape, as shown in FIG. 2B, compressive stresses in the directions indicated by arrows act on the region near the extending end edge 19 of each side portion. However, the narrow belt portions 24 have no good resistance against the compressive stresses. During press molding operation, therefore, each belt portion 24 is compressed to undergo intensive plastic deformation such that it is in the form of bellows having fine wrinkles. As the belt portions 24 are plastically deformed like bellows, they absorb the odd of the blank produced during the molding operation.

As the belt portions 24 are deformed, moreover, the apertures 22 are also deformed to be narrowed, thereby absorbing the odd of the skirt portion 18 in the regions between the peripheral edge 21 and the belt portions 24. Thus, the apertures 22 and the deformation of the belt portions 24 can absorb the odds in the individual side portions of the skirt portion 18 substantially throughout of the circumference.

Since the press-molded skirt portion 18 is made to be continuous throughout the circumference by means of the bellows-shaped belt portions 24 without being divided by the apertures 22, moreover, it can enjoy satisfactory strength and maintain its shape.

FIG. 4 shows an odd in the region at a distance of 3 mm on the side of the extending end edge 19 from the peripheral edge 21 that corresponds to the respective vertices of the apertures 22, in each side portion of the skirt portion 18. A curvature radius R3 of the circular arc of this region is 947 mm (=950 mm−3 mm), and its length is 289 mm (=2×π×947 mm×17.5/360). In this region, the difference in length from the peripheral edge 21 is only 1 mm (=290 mm−289 mm), which can be regarded as an allowable odd.

Although the long side portion of the skirt portion 18 has been described above in the main, each short side portion is constructed in the same manner. Thus, in the short side portions, as in the long side portions, the odds of the blank can be absorbed during press molding operation, and satisfactory strength can be ensured.

According to the color cathode ray tube constructed in this manner, each of the apertures 22 in the skirt portion of the shadow mask is wider in the region nearer to the extending end edge of the skirt portion, and the narrow belt portion 24 is left between each aperture 22 and the extending end edge 19 of the skirt portion 18. Thus, the apertures 22 can absorb the odds of the blank that are produced as the shadow mask is press-molded. Further, the odds of the blank can be absorbed more securely by positively subjecting the skirt portion to intensive plastic deformation in positions corresponding to the belt portions 24. Furthermore, the belt portions 24 can fully maintain the strength of the skirt portion 18. Accordingly, the skirt portion 18 can be prevented from spreading due to its odds, so that the molding accuracy of the curved surface of the mask 6 can be improved, and lowering of color purity or the like can be avoided. Thus, the resulting color cathode ray tube enjoys satisfactory display characteristics.

Figure 5A:
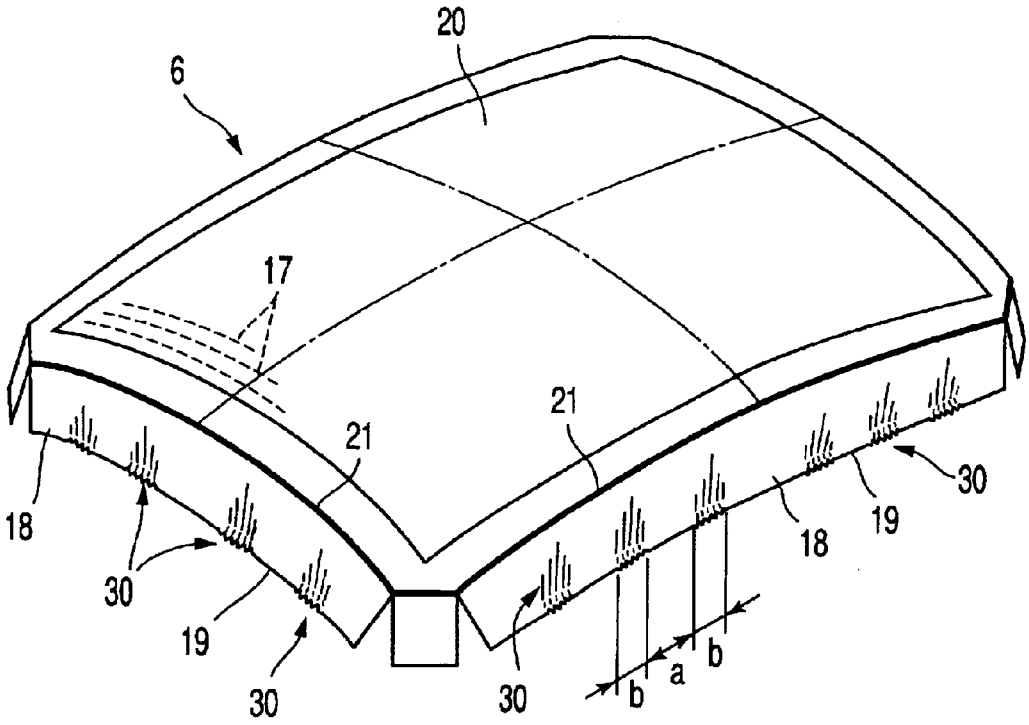
FIG. 5A is a perspective view showing a shadow mask according to a second embodiment of the invention.
Figure 5B:
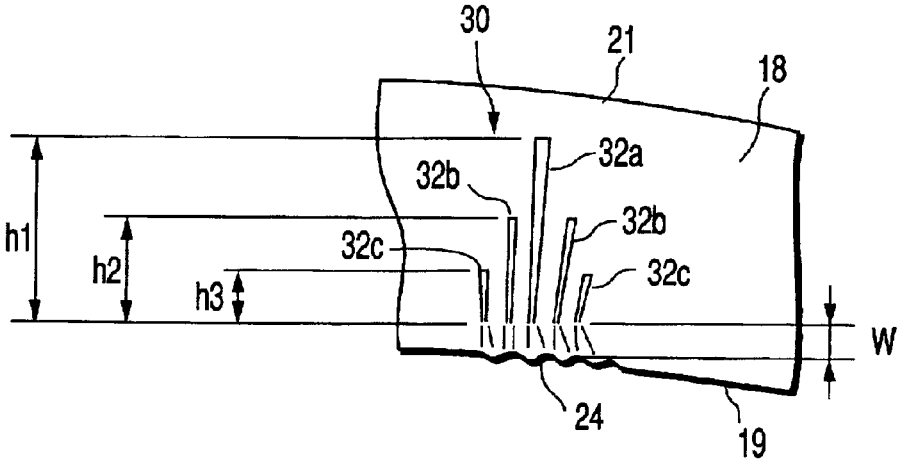
FIG. 5B is an enlarged side view showing a part of the shadow mask shown in FIG. 5A.

The following is a description of the shadow mask of a color cathode ray tube according to a second embodiment of the invention. According to the second embodiment, as shown in FIGS. 5A and 5B, the long and short side portions of a skirt portion 18 of a shadow mask 6 are provided with a plurality of slit groups 30 in place of the aforesaid apertures.

Each slit group 30 includes five slits, for example. These slits extend substantially at right angles to each extending end edge 19 of the skirt portion 18, and are arranged at spaces in a direction substantially parallel to the extending end edge 19. Each slit is formed having a width of 0.3 mm.

In each slit group 30, a central slit 32*a*, the longest one, has a length h1 of 7 mm, side slits 32*b* on the opposite sides of the central slit, individually, have a length h2 of 4 mm, and outermost side slits 32*c* have a length h3 of 2 mm. Thus, each slit group 30 has a substantially triangular shape as a whole.

In each slit group 30, moreover, the distance between each of the slits 32*a* to 32*c* and the extending end edge 19 of the skirt portion 18 is adjusted to 3 mm. Thus, a belt portion 24 with a width W of 3 mm is formed between the slit group 30 and the extending end edge 19. If the width of each slit group 30 in the longitudinal direction of each side portion and the distance between each two adjacent slit groups are b and a, respectively, there is a relation a>b.

For other configurations, the second embodiment is arranged in the same manner as the first embodiment, so that like reference numerals are used to designate like portions, and a detailed description of those portions will be omitted.

According to the shadow mask 6 constructed in this manner, the length of an odd at the upper end portion of each slit group 30 (portion at a distance of 10 mm from the extending end edge 19), in each side portion of the skirt portion 18, is 1 mm, as mentioned before. One slit or the central slit 32*a* in each slit group 30 (six in total for each entire long side portion) reaches the position at 10 mm from the extending end edge 19. As the shadow mask 6 is press-molded, therefore, these slits can absorb odds of 1.8 mm (=0.6 mm×6) in total.

Five slits 32*a* to 32*c* are arranged at the lower end portion of each slit group 30, and six slit groups 30 are provided on each long side. As the shadow mask 6 is press-molded, therefore, odds of 9 mm (=0.3 mm×5×6) can be absorbed in total in each extending end edge portion of the skirt portion 18. Since the length of the odd in the extending end edge portion of each long side portion of the skirt portion 18 is 4 mm, as described in connection with the foregoing embodiment, the odds can be fully absorbed by means of the slit groups 30.

Further, the belt portion 3 mm wide is provided between each slit group 30 and the extending end edge of the skirt portion. As in the case of the foregoing embodiment, therefore, each belt portion 24 positively undergoes intensive plastic deformation, thereby forming bellows-shaped wrinkles, as the shadow mask 6 is press-molded. Thus, the belt portions 24 serve to absorb the odds and maintain the strength of the molded skirt portion.

The second embodiment can produce the same effects of the foregoing embodiment, and there may be provided a color cathode ray tube that enjoys improved molding accuracy for the curved surface of the mask and satisfactory display characteristics without the possibility of lowering of color purity or the like.

In each of the embodiments described above, six or seven apertures or slit groups are provided in the long side portion of the skirt portion, and four or five on the short side portion. If necessary, however, seven or more and five or more may be provided in the long and short side portions, respectively. In the second embodiment, moreover, a large number of slit groups may be arranged throughout the circumference of the skirt portion.

Figure 6:
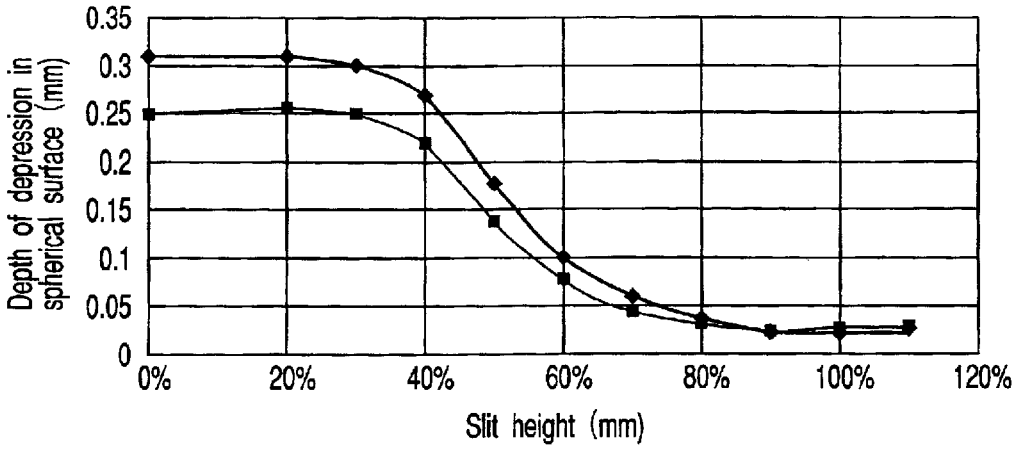
FIG. 6 is a diagram showing the relations between the height of a central slit in each slit group of the shadow mask according to the second embodiment and errors caused as the shadow mask is molded.
Figure 7:
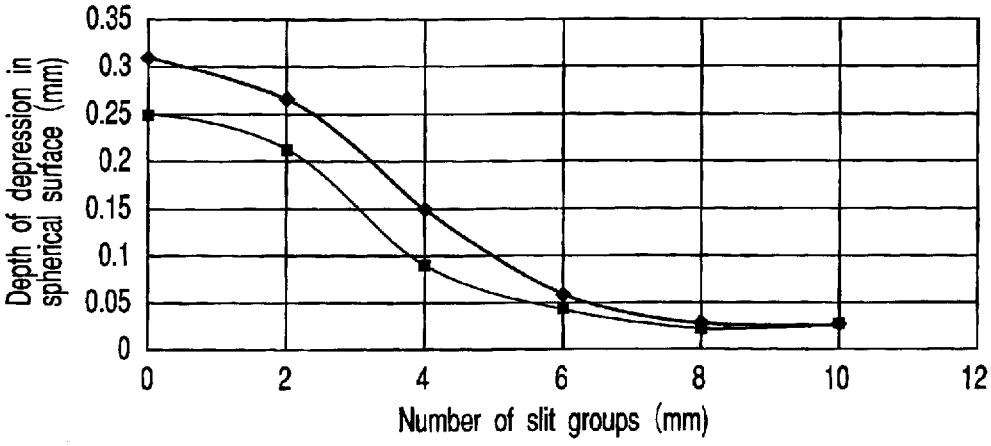
FIG. 7 is a diagram showing the relations between the number of slit groups in each side portion of the skirt portion according to the second embodiment and errors caused as the shadow mask is molded.

TABLE 1 and FIG. 6 show the relations between the height h1 of the central slit in each slit group of the shadow mask according to the second embodiment and errors caused as the shadow mask is molded. TABLE 2 and FIG. 7 show the relations between the number of slit groups in each side portion of the skirt portion and errors caused as the shadow mask is molded.

TABLE 1

| Slit height | 0% | 20% | 30% | 40% | 50% | 60% | 70% | 80% | 90% | 100% | 110% |
|---|---|---|---|---|---|---|---|---|---|---|---|
| Errors in long side portion | 0.31 | 0.31 | 0.30 | 0.27 | 0.18 | 0.10 | 0.06 | 0.04 | 0.02 | 0.02 | 0.02 |
| Errors in short side portion | 0.25 | 0.26 | 0.25 | 0.22 | 0.14 | 0.08 | 0.05 | 0.03 | 0.02 | 0.03 | 0.03 |

TABLE 2

| Number of slit groups | 0 | 2 | 4 | 6 | 8 | 10 |
|---|---|---|---|---|---|---|
| Errors in long side portion | 0.31 | 0.26 | 0.15 | 0.06 | 0.03 | 0.03 |
| Errors in short side portion | 0.25 | 0.21 | 0.09 | 0.05 | 0.03 | 0.03 |

The height of the central slit is represented by its ratio to the height H of the skirt portion, and an error indicates the depth of depression in the mask effective portion 20. The height H of the skirt portion 18 and the width W of each belt portion 24 are adjusted to 13 mm and 2 mm, respectively. If the slit groups are few, depressions are formed in a part of the periphery of the mask effective portion 20, so that the deepest one of them is measured.

The depth of depression in the mask effective portion 20 was measured in the following manner. In the case where the molded mask effective portion is nearly spherical, the respective heights of the central and outermost peripheral portions are measured. If the horizontal distance between these two points and the difference in height between them are rf and z, respectively, an ideal curvature radius R can be calculated as follows:

$$R=(rf^2+z^2)/(2z).$$

The deviation of a measured value from a curved line with the ideal curvature radius R was regarded as the depth of depression. If the curved surface is an aspherical surface represented by an expression of high order such that measurement based on a spherical surface is subject to a substantial error, any spot on the spherical surface may be measured so that an approximate value obtained from the then values of rf and z can be regarded as the value for the ideal curved surface.

If the height of the central slit is adjusted to less than 50%, as seen from TABLE 1 and FIG. 6, a satisfactory effect to reduce errors cannot be produced, although some odds can be absorbed. If the height of the central slit is adjusted to 50% or more, on the other hand, the depth of depression in the mask effective portion 20 is halved, and the mask effective portion obtained can enjoy a high-accuracy curved surface.

As seen from TABLE 2 and FIG. 7, moreover, a certain effect can be obtained if two slit groups are provided in each side portion. If four or more slit groups are provided, however, the depth of depression in the mask effective portion can be halved to ensure a high effect.

Figure 8A:
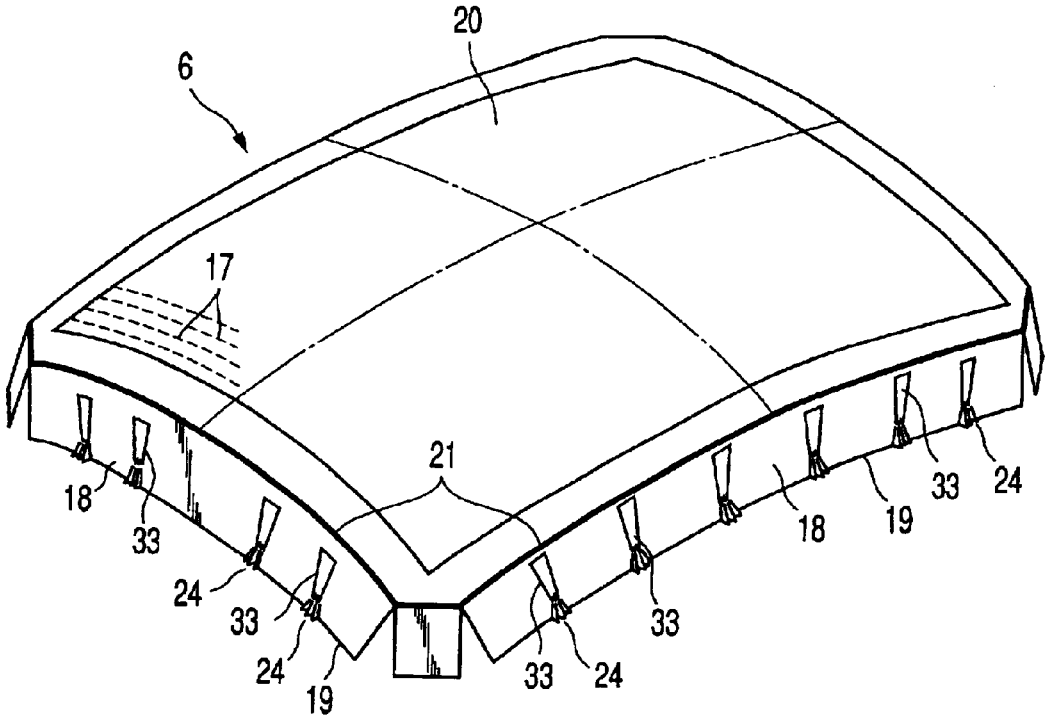
FIG. 8A is a perspective view showing a shadow mask according to a third embodiment of the invention.
Figure 8B:
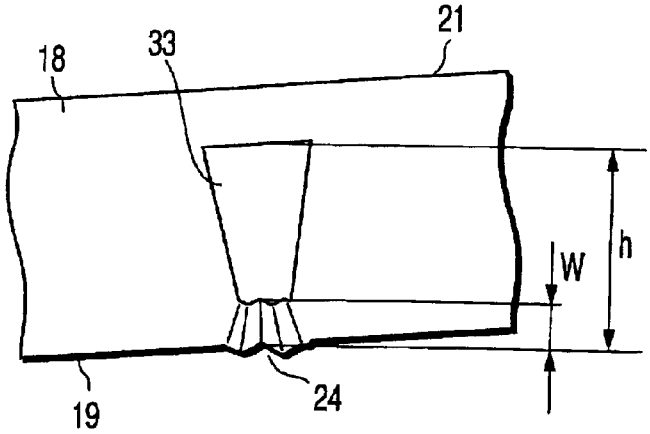
FIG. 8B is an enlarged side view showing a part of the shadow mask shown in FIG. 8A.

The following is a description of the shadow mask of a color cathode ray tube according to a third embodiment of the invention. According to the third embodiment, as shown in FIGS. 8A and 8B, the long and short side portions of a skirt portion 18 of a shadow mask 6 are provided with oblong apertures 33, which have upper and lower parts with equal widths, in place of the triangular apertures.

Each aperture 33 is formed having a height h of 10 mm and a width of 3 mm. A belt portion 24 formed between each aperture 33 and an extending end edge 19 of a skirt portion 18 has a width W of 3 mm.

The third embodiment shares the locations and number of the apertures 33 with the first embodiment. For other configurations, the third embodiment is arranged in the same manner as the foregoing embodiments, so that like reference numerals are used to designate like portions, and a detailed description of those portions is omitted.

According to the shadow mask 6 constructed in this manner, each belt portion 24 is compressed to undergo intensive plastic deformation such that it is in the form of bellows having fine wrinkles during press molding operation. As the belt portions 24 are plastically deformed like bellows, they absorb an odd of the blank produced during the molding operation. As the belt portions 24 are deformed, moreover, the apertures 33 are also deformed so that their respective lower parts are narrowed, thereby absorbing the odd of the skirt portion 18 in the regions between a peripheral edge 21 of the skirt portion and the belt portions 24. After the press molding operation, each aperture 33 is substantially in the shape of a trapezoid having its bottom shorter than its top. Thus, the third embodiment can produce the same effects of the foregoing first embodiment.

In each of the first to third embodiments, it is essential to set the width W of each belt portion 24 appropriately. If the width W of each belt portion 24 is too great, the belt portions cannot be effectively collapsed when they are subjected to compressive stress as the shadow mask is press-molded, so that the effect of absorbing the odd cannot be ensured. If the width W of each belt portion 24 is too small, on the other hand, the strength of the belt portions inevitably lowers although they can be collapsed effectively.

Figure 9:
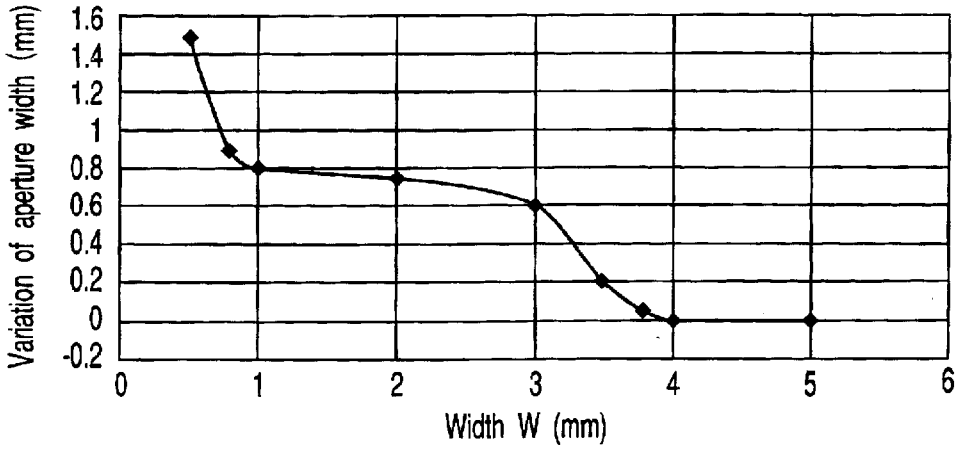
FIG. 9 is a diagram showing the relation between the variation of the aperture width in each side portion of a short side portion according to the third embodiment and the width of each belt portion.

The variation of the aperture width or the extent of collapse of each aperture 33 of the shadow mask according to the third embodiment, for example, was measured with the height h of each aperture 33 fixed and the width W of each belt portion 24 varied. TABLE 3 and FIG. 9 show the results of the measurement.

TABLE 3

| Width W (mm) | 0.5 | 0.8 | 1 | 2 | 3 | 3.5 | 3.8 | 4 | 5 |
|---|---|---|---|---|---|---|---|---|---|
| Variation of aperture width (mm) | 1.5 | 0.9 | 0.8 | 0.75 | 0.6 | 0.2 | 0.05 | 0 | 0 |

The above measurement results indicate that the belt portions 24 can be effectively collapsed to change the width of the apertures 33 if their width W is 3 mm or less. If the width W is 4 mm or more, the belt portions are too strong to be effectively collapsed, so that the apertures 33 cannot produce any effect.

If the width W of each belt portion 24 is less than 1 mm, on the other hand, the belt portions and the apertures 33 can be collapsed effectively. Since the belt portions 24 are not strong enough, however, they sometimes may partially fall off, failing to resist friction with a press tool as the shadow mask is press-molded. This inevitably results in reduction of the efficiency of shadow mask production.

Therefore, it is desirable that the width W of each belt portion 24 is set within the range from 1 to 3 mm.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

For example, the specific shape and the number of apertures or slits in the skirt portion of the shadow mask may be variously selected as required, depending on the size, type, etc. of the color cathode ray tube, as long as the aforesaid requirements are fulfilled.

What is claimed is:

1. A color cathode ray tube comprising:

a panel having a phosphor screen on the inner surface thereof, the phosphor screen having a plurality of phosphor layers;

an electron gun located opposite the phosphor screen and configured to emit electron beams toward the phosphor screen; and a shadow mask located opposite the phosphor screen and having a large number of electron beam passage apertures through which the electron beams are applied to the phosphor layers corresponding thereto, the shadow mask being formed by press molding and including a substantially rectangular mask effective portion in the form of a gently sloped dome having the electron beam passage apertures and a skirt portion extending from the peripheral edge of the mask effective portion substantially at right angles thereto, the skirt portion having a plurality of skirt portion apertures arranged to be spaced from one another in a direction parallel to the peripheral edge of the mask effective portion, and belt portions formed between the skirt portion apertures and an extending end edge of the skirt portion and extending along the extending end edge, the belt portions having wrinkles formed along the extending end edge by the press molding.

2. A color cathode ray tube according to claim 1, wherein the width of each of the belt portions ranges from 1 to 3 mm.

3. A color cathode ray tube according to claim 1, wherein the width of each of the skirt portion apertures increases from the peripheral edge of the mask effective portion toward the extending end edge side of the skirt portion.

4. A color cathode ray tube according to claim 3, wherein each said aperture is triangular.

5. A color cathode ray tube according to claim 3, wherein the distance between the end of each skirt portion aperture on the peripheral edge side of the mask effective portion and the extending end edge of the skirt portion accounts for 50% or more of the distance between the peripheral edge of the mask effective portion and the extending end edge of the skirt portion.

6. A color cathode ray tube according to claim 3, wherein the width of each of the belt portions ranges from 1 to 3 mm.

7. A color cathode ray tube according to claim 1, wherein the width of each skirt portion aperture along the extending end edge of the skirt portion is narrower than the distance between each two adjacent skirt portion apertures.

8. A color cathode ray tube comprising:

a panel having a phosphor screen on the inner surface thereof, the phosphor screen having a plurality of phosphor layers;

an electron gun located opposite the phosphor screen and configured to emit electron beams toward the phosphor screen; and a shadow mask located opposite the phosphor screen and having a large number of electron beam passage apertures through which the electron beams are applied to the phosphor layers corresponding thereto, the shadow mask being formed by press molding and including a substantially rectangular mask effective portion in the form of a gently sloped dome having the electron beam passage apertures and a skirt portion extending from the peripheral edge of the mask effective portion substantially at right angles thereto, the skirt portion having a plurality of slit groups arranged to be spaced from one another in a direction parallel to the peripheral edge of the mask effective portion, and belt portions defined between the slit groups and an extending end edge of the skirt portion and extending along the extending end edge, each of the slit groups including a plurality of slits extending substantially at right angles to the extending end edge of the skirt portion and arranged at spaces in a direction substantially parallel to the extending end edge, the slits including a central slit, the longest one, and side slits arranged on the opposite sides of the central slit and having lengths reduced stepwise.

9. A color cathode ray tube according to claim 8, wherein each of the slit groups, including the central and side slits, is substantially triangular.

10. A color cathode ray tube according to claim 8, wherein the distance between the end of the central slit in each slit group on the peripheral edge side of the mask effective portion and the extending end edge of the skirt portion accounts for 50% or more of the distance between the peripheral edge of the mask effective portion and the extending end edge of the skirt portion.

11. A color cathode ray tube according to claim 8, wherein the width of each of the belt portions ranges from 1 to 3 mm.

12. A color cathode ray tube according to claim 8, wherein the width of each of the slit groups along the extending end edge of the skirt portion is narrower than the distance between each two adjacent slit groups.

* * * * *